US011390927B2

(12) United States Patent
Terlicher et al.

(10) Patent No.: US 11,390,927 B2
(45) Date of Patent: Jul. 19, 2022

(54) MELTING FURNACE FOR METALLURGICAL PLANT AND OPERATING METHOD THEREFOR

(71) Applicant: DANIELI & C. OFFICINE MECCANICHE S.p.A., Buttrio (IT)

(72) Inventors: Stefano Terlicher, Cividale del Friuli (IT); Mattia D'odorico, San Giovanni al Natisone (IT); Michael Sansa, San Lorenzo Isontino (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 0 days.

(21) Appl. No.: 16/772,385

(22) PCT Filed: Dec. 14, 2018

(86) PCT No.: PCT/IB2018/060090
§ 371 (c)(1),
(2) Date: Jun. 12, 2020

(87) PCT Pub. No.: WO2019/116333
PCT Pub. Date: Jun. 20, 2019

(65) Prior Publication Data

US 2021/0079489 A1 Mar. 18, 2021

(30) Foreign Application Priority Data

Dec. 15, 2017 (IT) ..... 102017000145098

(51) Int. Cl.
*C21C 5/46* (2006.01)
*C21C 5/52* (2006.01)
(Continued)

(52) U.S. Cl.
CPC ..... *C21C 5/4653* (2013.01); *C21C 5/527* (2013.01); *F27B 3/19* (2013.01); *F27D 3/1509* (2013.01); *F27B 3/065* (2013.01)

(58) Field of Classification Search
CPC ..... C21C 5/4653; C21C 5/527; F27B 3/19; F27D 3/1509; F27D 3/1518
(Continued)

(56) References Cited

U.S. PATENT DOCUMENTS 4,679,205 A * 7/1987 Heidenreich ..... F27B 3/19 373/84
6,473,446 B2 * 10/2002 Stercho ..... F27B 3/085 373/72
(Continued)

FOREIGN PATENT DOCUMENTS

EP 1743948 * 1/2007 ..... C21C 5/4653
EP 1743948 A2 1/2007

OTHER PUBLICATIONS

Patent Cooperation Treaty, International Search Report and Written Opinion for International Application No. PCT/IB2018/060090, dated Feb. 5, 2019, 11 pages.

*Primary Examiner* — Scott R Kastler
*Assistant Examiner* — Michael Aboagye
(74) *Attorney, Agent, or Firm* — Stetina Brunda Garred and Brucker

(57) ABSTRACT

A melting furnace for metallurgical plant comprising a vessel provided with a bottom; a tapping duct passing through the bottom; rotation means to rotate the vessel so that the tapping duct passes from a first reference position to a second position inclined with respect to said first reference position, and vice versa; wherein said tapping duct has a first stretch arranged in the thickness of the bottom and completely passing through the bottom, and a second stretch, adjacent to the first stretch, protruding inside the vessel;
(Continued)

wherein there is provided a cover of the second stretch shaped as a tube closed at an upper end thereof and open at a lower end thereof; said tube being coaxial and spaced from said second stretch, and being spaced from a zone of the bottom which includes the first stretch of the tapping duct, whereby the cover, in cooperation with the second stretch of the tapping duct, acts as a tapping hood.

5 Claims, 4 Drawing Sheets

(51) Int. Cl.
*F27B 3/19* (2006.01)
*F27D 3/15* (2006.01)
*F27B 3/06* (2006.01)

(58) Field of Classification Search
USPC ..... 266/45, 240, 236, 245, 246; 373/142, 373/143; 222/590, 593
See application file for complete search history.

(56) References Cited

U.S. PATENT DOCUMENTS 6,596,221 B1 * 7/2003 Fuchs ..... B22D 11/10 222/590
8,562,713 B2 * 10/2013 Guliana ..... C21C 7/0075 75/10.66

* cited by examiner

MELTING FURNACE FOR METALLURGICAL PLANT AND OPERATING METHOD THEREFOR

CROSS-REFERENCE TO RELATED APPLICATIONS

This application claims priority to PCT International Application No. PCT/IB2018/060090 filed on Dec. 14, 2018, which application claims priority to Italian Patent Application No. 102017000145098 filed on Dec. 15, 2017, the disclosures of which are expressly incorporated herein by reference.

STATEMENT RE: FEDERALLY SPONSORED RESEARCH/DEVELOPMENT

Not applicable.

FIELD OF THE INVENTION

The present invention relates to a melting furnace, e.g. an electric arc furnace, and operating method thereof, said melting furnace being used in a metallurgical plant.

BACKGROUND ART

The melting process conventionally envisages melting metal scrap by generating electric arcs, adapted to be sparked, in alternating current melting furnaces, between the electrodes arranged on the roof and the scrap, and adapted to be sparked, in direct current melting furnaces, between at least one electrode placed above (cathode) and at least a bottom electrode (anode) placed under the floor or bottom of the furnace.

This produces extremely high temperatures, which make the metal material melt and liquefy, whereby causing the formation of a metal bath and a foamy layer, called slag, on the surface of said metal bath.

A single charge of scrap is not normally sufficient to obtain the nominal amount of molten product, whereby the furnace is normally filled with multiple loads of scrap by means of hanging baskets or through continuous conveying systems.

In the first case, i.e. charging by means of hanging baskets, the roof covering the furnace is opened and the scrap of a first basket is unloaded. The roof is then closed and the melting of the load starts and usually lasts about 20-25 minutes.

During this step, the electrodes, possibly helped by blow torches and burners, liquefy the scrap whereby forming the metal bath, which will help melting the scrap of successive baskets.

The operation is repeated with a second basket: the electric arc is stopped, the electrodes are moved off-line together with roof and the basket is emptied into the vessel. The roof closes, the electrodes resume melting the scrap and the overall level of the bath increases.

According to the volume of the furnaces, further loading operations made according to this procedure may be envisaged.

Continuous loading, instead, normally begins by loading the scrap of a first basket and then, by means of a continuous conveyor system, material is continuously added to achieve the desired amount of liquid product and, in the meantime, the electrodes melt the scrap. Alternatively, the furnace can be directly loaded by means of the continuous conveyor system.

Once the desired amount of scrap has been reached, the so-called refining step starts, which makes it possible to obtain the product with the desired chemical composition.

The refining step takes approximately a quarter of the entire melting cycle and, once finished, the work of the electrodes is interrupted for the tapping step, which takes approximately ten minutes.

In general, a melting cycle takes approximately 45-55 minutes, of which 7-10 minutes are used for tapping. The melting furnace has an eccentric bottom tapping (EBT) hole, located at the bottom of the vessel. The molten and deslagged steel is tapped by opening the EBT hole. This hole, coated with refractory material, is kept closed during melting operations by a movable valve. At the time of tapping, the valve is opened, by means of pneumatic or hydraulic devices, allowing the outflow of the molten steel. After tapping, the valve is closed again and the EBT hole is sealed with refractory sand, taking care to maintain a certain amount of molten steel inside the vessel, to facilitate successive melting (so-called hot heel). Once the necessary amount is tapped, the tapping flow is interrupted, the tapping area is cleaned from the outside and sand is loaded into the tapping hole from the inside to prevent the liquid metal from remaining inside it during the successive melting operations. This sand is usually loaded by means of trapdoors above the EBT hole.

As mentioned, all these operations take approximately one fifth of the time of an entire melting operation (20%).

Document EP1743948A2 also discloses a melting furnace in which the tapping hole or passage is kept closed during melting operations by a movable valve. At the time of tapping, the valve is opened allowing the outflow of molten metal by gravity. In the vessel there is in fact provided a level P of molten metal much higher than the upper edge O of the tapping duct. As shown in FIGS. 2a-2e of EP1743948A2, when the level P of the molten metal reaches an intermediate position between the lower edge U of the cover or movable hood and upper edge O of the tapping duct, the movable cover is lowered so that its lower edge U is immersed in the molten metal and a depression is formed inside the movable cover by means of an air suction duct, provided over the cover, so that the tapping can continue.

After tapping, the movable valve is closed again and the tapping duct is sealed with refractory sand.

The need is therefore felt to shorten the downtimes inherent in the tapping process currently in use while simplifying the steps for restoring the tapping hole, by eliminating the need for loading refractory sand.

SUMMARY OF THE INVENTION

It is the aim of the present invention to provide a melting furnace and an operating method thereof, which ensure greater productivity, shortening the downtimes of the tapping process with respect to melting furnaces of the prior art.

It is another aim of the present invention to provide a melting furnace, which is simpler from the constructive point of view, and an operating method thereof which is simpler and more efficient with respect to the prior art.

It is a further aim of the present invention to provide a melting furnace and operating method thereof which facilitate and control in optimal manner the liquid metal flow during the step of tapping, thus eliminating most of the power-off times, so as to be able to continue melting also during tapping.

It is another aim of the present invention to provide a melting furnace and operating method thereof which make it possible to improve the control of the bath level at the end of tapping.

It is a further aim of the present invention to simplify the steps for restoring the tapping hole, by eliminating the need for loading the refractory sand.

Such aims are achieved by means of a melting furnace for metallurgical plant comprising a vessel provided with a bottom;

a tapping duct passing through the bottom;

rotation means to rotate the vessel so that the tapping duct passes from a first reference position to a second position inclined with respect to said first reference position, and vice versa; wherein said tapping duct has a first stretch arranged in the thickness of the bottom and completely passing through the bottom, and a second stretch, adjacent to the first stretch, protruding inside the vessel;

wherein there is provided a fixed cover of the second stretch shaped as a bell, closed at an upper end thereof and open at a lower end thereof; said bell being coaxial and spaced from said second stretch, and being spaced from a zone of the bottom which includes the first stretch of the tapping duct, whereby the cover, in cooperation with the second stretch of the tapping duct, defines a volume inside the cover and adapted to act as a tapping hood.

A further aspect of the invention relates to an operating method of said melting furnace which either comprises or consists of the following steps:

a) providing the vessel with the tapping duct in the first reference position and providing a bath of molten metal material at an equal level both inside and outside the cover and comprised between the lower end of the cover and an upper edge of the second stretch, a slag being kept on the surface of said bath outside the cover;

b) rotating the vessel in a first direction so that the tapping duct passes from said first reference position to a second position inclined with respect to said first reference position until the level of molten metal material reaches the upper edge of the second stretch so that the molten metal material begins to be tapped through the tapping duct creating a depression inside the volume;

c) rotating the vessel in a second direction, opposite the first direction, so that the tapping duct returns to the first reference position, while, due to said depression, the molten metal material passes from the outside of the cover to the inside of the volume and continues to be tapped through the tapping duct until said depression is canceled.

In order to achieve these aims, the present solution provides modifying the zone of the tapping hole EBT, so that it can be implemented even on existing furnaces, in addition to new furnaces, working either in alternating current or direct current. The layout of the furnace is therefore modified, increasing the height of the EBT hole towards the inside of the furnace body, whereby creating a sort of well.

The solution of the invention makes it possible to increase the productivity of the melting furnace by reducing downtimes: indeed, it is possible to continue melting or loading charges by means of baskets of scrap or a continuous conveying system, while tapping, recovering nearly entirely the downtimes existing in the processes of the prior art.

Advantageously, moreover, it is no longer necessary to fill the EBT hole with sand.

The operating principle of the tapping system according to the invention is based on the pressure difference which will be created between the inside and the outside of the tapping hood, or siphon.

In order to induce such a pressure difference, the preferred solution exploits an inclination system of the vessel to induce the molten material to enter into the cover or hood. In this manner, part of the air contained in the cover is expelled by the molten material towards the outside of the cover, thus producing the depression sufficient to initiate the outflow of molten product along the tapping well. Once the depression is induced, the molten material will start flowing out along the siphon and along the tapping duct whereby filling the ladle underneath. Means specially provided to obtain such depression, such as for example a suction conduit for aspirating air from the inside of the fixed cover and respective valve, are therefore not needed.

It is sufficient to cancel such pressure difference to stop the tapping. Indeed, according to the principle of communicating vessels, the applied pressure being equal, the molten material contained in the furnace reaches the same level inside and outside the cover, whereby defining a single equipotential surface.

In order to cancel this pressure difference, a first variant provides waiting for the level of molten material contained in the furnace to decrease until it no longer covers, and therefore no longer seals, the cover. As soon as the air can pass inside the cover, the pressure difference will be canceled and the outflow will be interrupted.

A second variant provides actuating a relief valve located on the cover itself, which equalizes internal pressure of the cover with that contained in the furnace, which generally corresponds to atmospheric pressure.

A third variant provides, instead, tilting the vessel with respect to the horizontal plane in direction opposite to the one activating the tapping, i.e. so as to raise the level of molten metal material in the vessel zone in which the tapping duct is not present.

In these different manners, it is obtained a perfect control on the amount of molten metal to be maintained inside the furnace (hot heel) for the successive melting.

The dependent claims describe preferred embodiments of the invention.

BRIEF DESCRIPTION OF THE FIGURES

Further features and advantages of the present invention will be more apparent in light of the detailed description of a preferred, but not exclusive, embodiment, of a melting furnace illustrated by way of non-limiting example, with reference to the accompanying drawings, in which.

Figure 1:
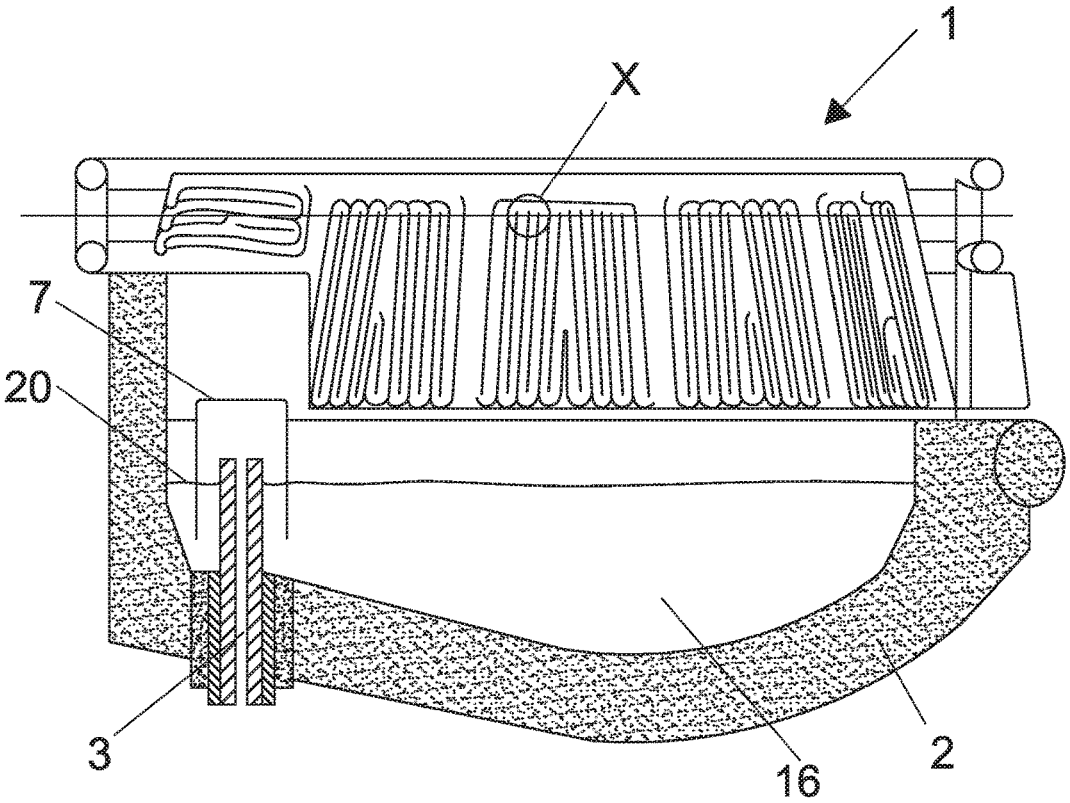
FIG. 1 is a diagrammatic section view of part of a melting furnace according to the invention.

Figures from 3*a* to 3*h* diagrammatically represent some working sequences of the melting furnace according to the invention.

The same reference numbers in the figures identify the same elements or components.

DETAILED DESCRIPTION OF PREFERRED EMBODIMENTS OF THE INVENTION

The figures show a melting furnace for metallurgical plant according to the invention.

The melting furnace is only partially shown in the figures and is represented as a whole by reference numeral 1. The melting furnace 1 is described only partially with particular reference to the elements which distinguish it from known furnaces. The parts of the furnace which are not described in detail herein should be understood as being in themselves known and conventional.

The melting furnace 1 of the invention comprises in all its embodiments:

a vessel having a bottom 2 which is part of the floor of the furnace and which comprises an inner surface adapted to be in contact with the metal mass or metal bath contained in the furnace 1;

a tapping duct 3 passing through the bottom 2;

rotation means to rotate the vessel about a rotation axis X so that the tapping duct 3 passes from a first reference position to a second position inclined with respect to said first reference position, and vice versa.

The rotation means comprise, for example, slides or rack mechanisms or shoes.

The tapping duct 3, preferably eccentric with respect to the bottom 2, has a first stretch 6 arranged in the thickness of the bottom 2 and completely passing through the bottom itself, and a second stretch 5, adjacent to the first stretch 6, protruding inside the vessel. A third stretch 10 of the tapping duct 3 can be provided which protrudes outside the vessel, under the base floor of the furnace. The stretches 5, 6 and the possible stretch 10 have the same longitudinal axis.

Advantageously, there is provided a cover 7 of the second stretch 5 shaped as a bell, preferably a tube closed at an upper end 8 thereof and open at a lower end 9 thereof. The cover 7 is a fixed cover, e.g. fixed to the walls of the vessel, coaxial and spaced from said second stretch 5 and also spaced from a zone of the bottom 2 which includes the first stretch 6 of the tapping duct 3, whereby the cover 7, in cooperation with the second stretch 5 of the tapping duct 3, defines a volume 4 inside the cover 7 and adapted to act as a siphon.

Both the cover 7 and the tapping duct 3 are made of refractory material or simply coated with a refractory material.

Figure 2:
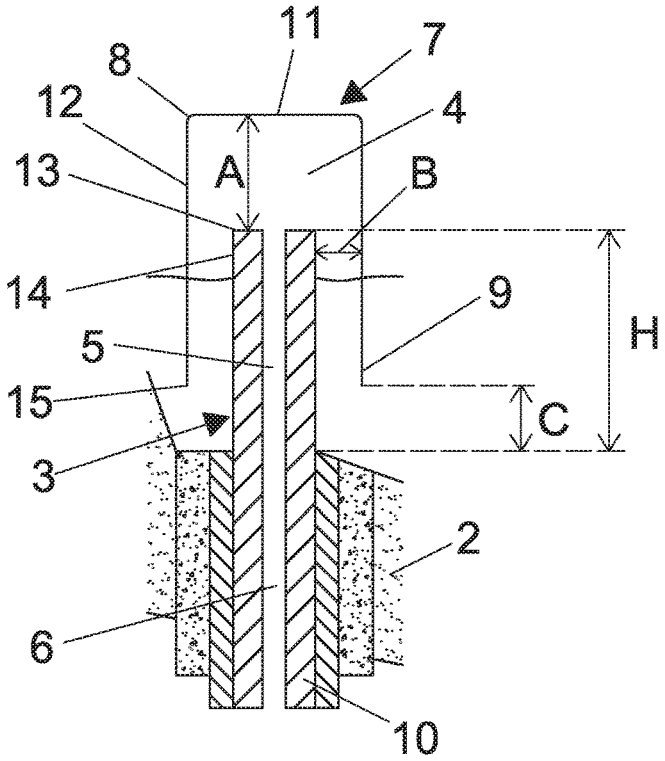
FIG. 2 is an enlargement of some components of the furnace in FIG. 1.

In the variant shown in FIGS. 1-2, having defined a maximum level 20 of the bath of molten metal material 16 inside the vessel, always comprised between the lower end 9 of the cover 7 and an upper edge 13 of the second stretch 5, said second stretch 5 of the tapping duct 3 has a length H, measured starting from the part of bottom 2 from which it protrudes, so that the upper edge 13 of the second stretch 5 is always over said maximum level 20.

Advantageously, the length of the second stretch 5 is greater than or equal to the thickness of the zone of the bottom 2 which includes the first stretch 6, preferably greater than or equal to the length of the first stretch 6.

Preferably, the length H of the second stretch 5 of the tapping duct 3, measured starting from the part of bottom 2 from which it protrudes, is comprised between 800 and 1100 mm.

The length of the first stretch 6 is preferably comprised between 600 and 850 mm. The length of the possible third stretch 10, for example, is comprised between 0 and 300 mm.

At least one burner can be provided at the outlet section of the stretch 6 or of the stretch 10, adapted to be actuated at the end of tapping to clean the lower end of the tapping duct.

The tube defining the cover 7 is defined by a base 11, placed at the upper end 8 thereof and spaced from an upper edge 13 of the second stretch 5 of the tapping duct 3, and by a cylindrical lateral surface 12 arranged coaxially to the tapping duct 3 and spaced from the outer wall 14 of the second stretch 5.

Preferably, the distance A between the base 11 and the upper edge 13 of the second stretch 5, the distance B between the cylindrical lateral surface 12 and the outer wall 14 of the second stretch 5, and the distance C between a lower edge 15 of the lower end 9 of the cover 7 and the zone of the bottom 2 which includes the first stretch 6, satisfy the following relationship: A=(B+C)*0.7.

Preferably, the distance A is comprised between 100 and 400 mm.

Preferably, the distance B is comprised between 80 and 300 mm.

Preferably, the distance C is comprised between 50 and 250 mm.

The angular distance between the second position and the first position of the tapping duct 3 is advantageously less than 10° so as to allow, even during the handling of the vessel and/or the tapping of the molten metal material, that further scrap can be charged into the vessel and that the melting can continue without interruption.

Preferably, said angular distance is comprised in the range between 3° and 8°, possibly including the limit values, still more preferably equal to 5°-6°, i.e. comprised in the range between 5° and 6° including the limit values.

Alternatively, the cover 7 can be a movable cover adapted to move along its own longitudinal axis.

An operating method of a melting furnace according to the invention, diagrammatically shown in Figures from 3*a* to 3*h*, is described below.

Figure 3A:
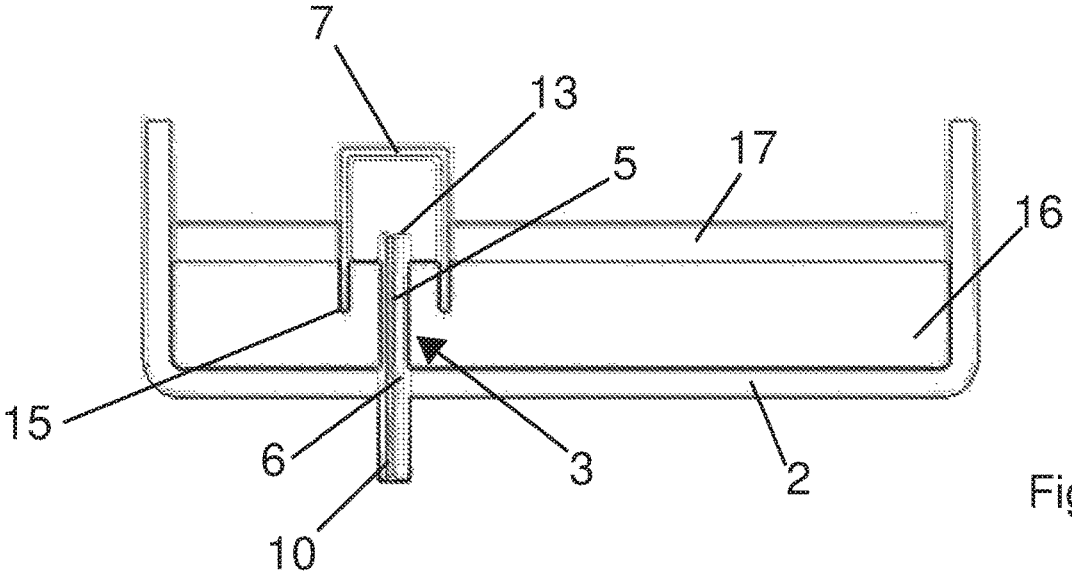

Initially, the vessel is provided with the tapping duct 3 in the first reference position, e.g. a vertical position, and there is provided a bath of molten metal material 16 at an equal level both inside and outside the cover 7 and comprised between the lower edge 15 of the cover 7 and an upper edge 13 of the second stretch 5, the slag 17 being kept on the surface of said bath 16 outside the cover 7 (FIG. 3*a*).

Therefore, the method of the invention does not provide an initial level of the molten metal material bath higher than the upper edge 13 of the second stretch 5 of the tapping duct, and therefore does not provide an initial tapping obtained exclusively by gravity.

Figure 3B:
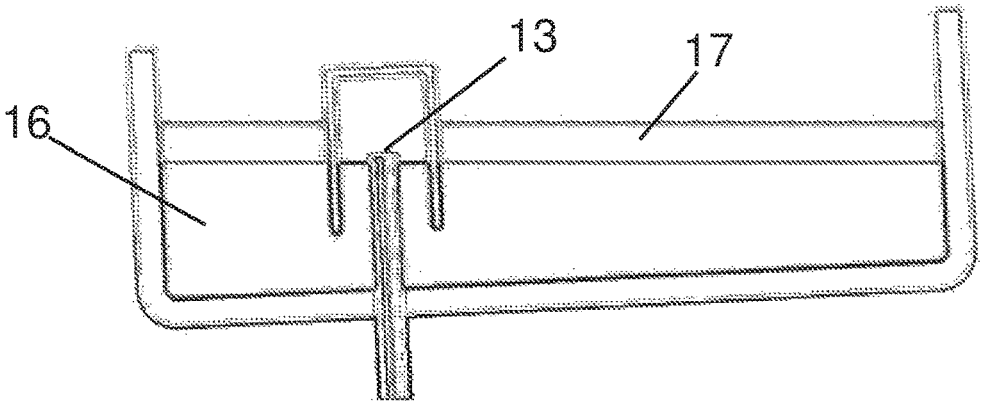

The vessel is then rotated in a first direction of rotation (FIGS. 3*b* and 3*c*) so as to raise the molten metal material level in the vessel zone comprising the tapping duct 3, so that the tapping duct 3 passes from said first reference position to a second position inclined with respect to said first reference position, preferably by an angle lower than 10°, until the level of molten metal material reaches the upper edge 13 of the second stretch 5 so that the molten metal material begins to be tapped through the tapping duct 3 whereby creating a depression inside the volume 4.

Figure 3C:
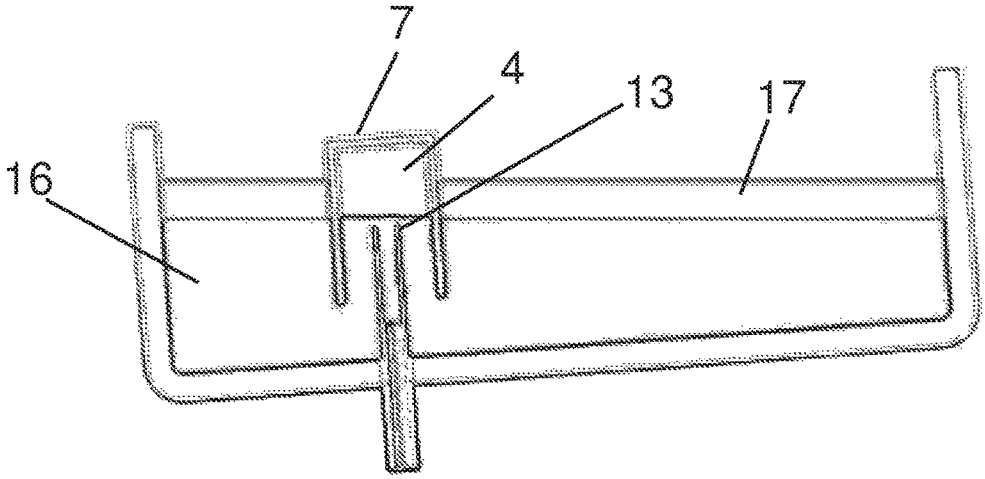

In particular, FIG. 3*c* shows a moment in which the level of the molten metal material inside the cover 7, i.e. inside the volume 4, exceeds the level of the upper edge 13 of the tapping duct 3, whereby the molten material starts flowing through the tapping duct 3.

The depression produced inside the cover 7, because of the beginning of the tapping, determines the passage of the molten metallic material from the outside of the cover 7 into the volume 4 while the tapping continues, whereby causing a difference of level between the molten material inside the cover 7 and the molten material outside said cover 7, the level becoming increasingly lower on the outside of the cover with respect to the inside.

Figure 3D:
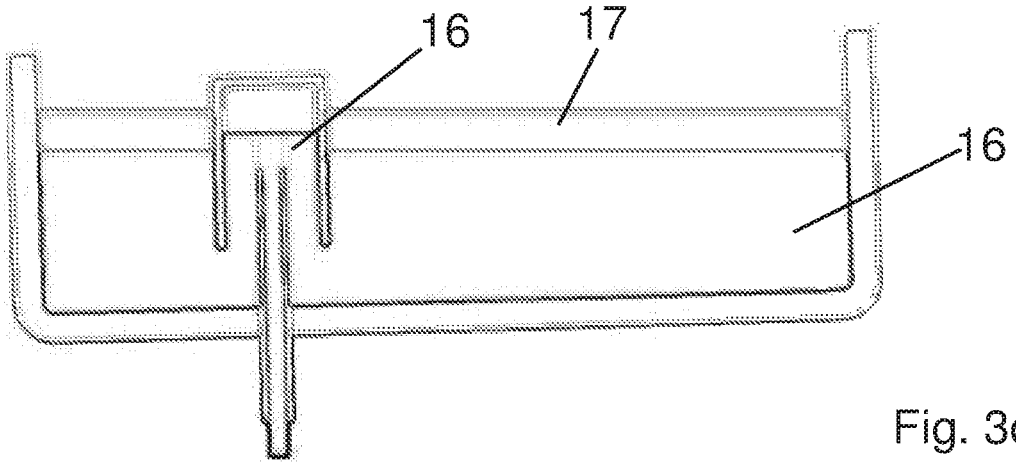
Figure 3E:
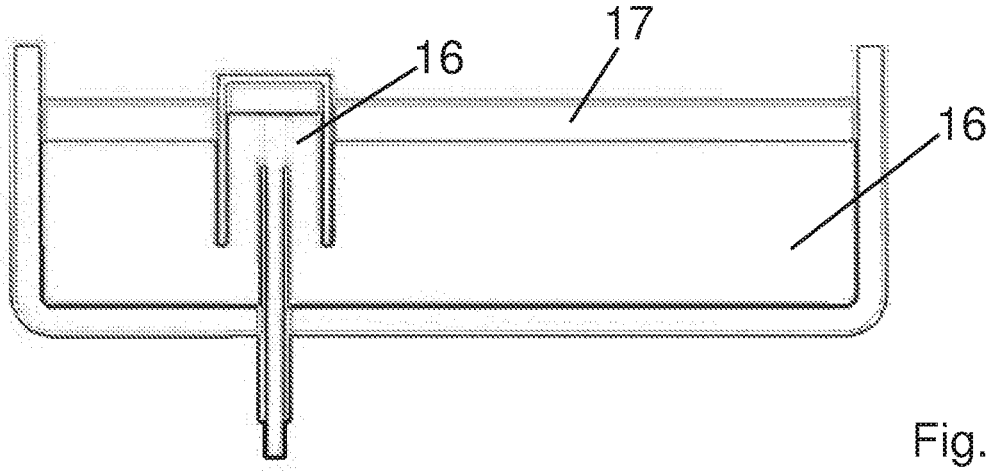
Figure 3F:
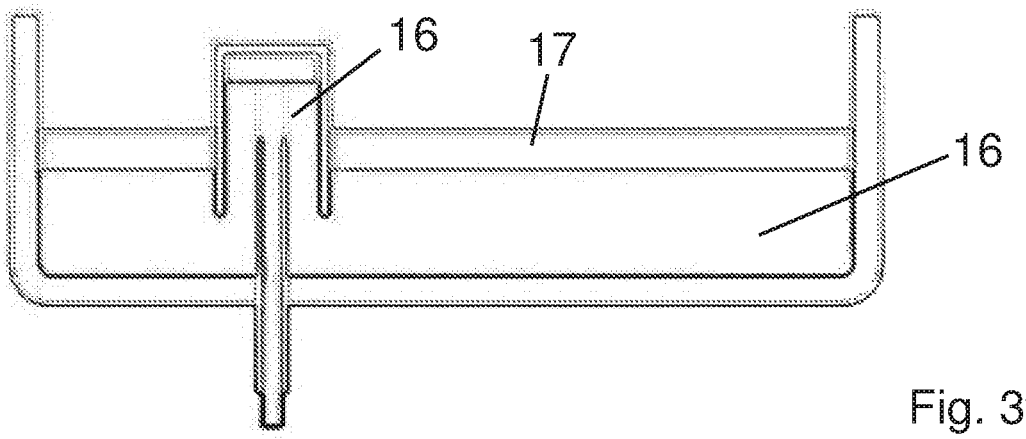

The vessel is then rotated in a second direction of rotation (FIGS. 3*d*, 3*e*, 3*f*), opposite to the first direction of rotation, so that the tapping duct 3 returns in the first reference position (FIG. 3*f*) while the tapping of the molten metallic material continues.

Advantageously, it is possible to load and/or melt the scrap in the vessel also while tapping. Indeed, FIGS. 3*c* to 3*e*, for example, show how the amount of molten metal material 16 increases inside the vessel.

Figure 3G:
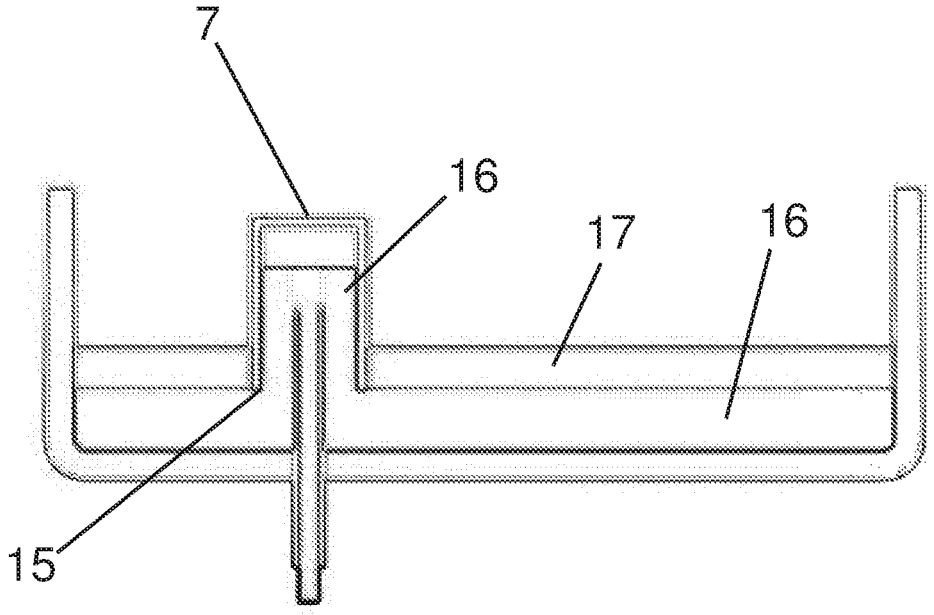

The molten metal material continues to pass from the outside of the cover 7 into the volume 4 and continues to be tapped through the tapping duct 3 until the level of molten metal material outside the cover 7 reaches the lower edge 15 of the lower end 9 of the cover 7 (FIG. 3*g*).

Figure 3H:
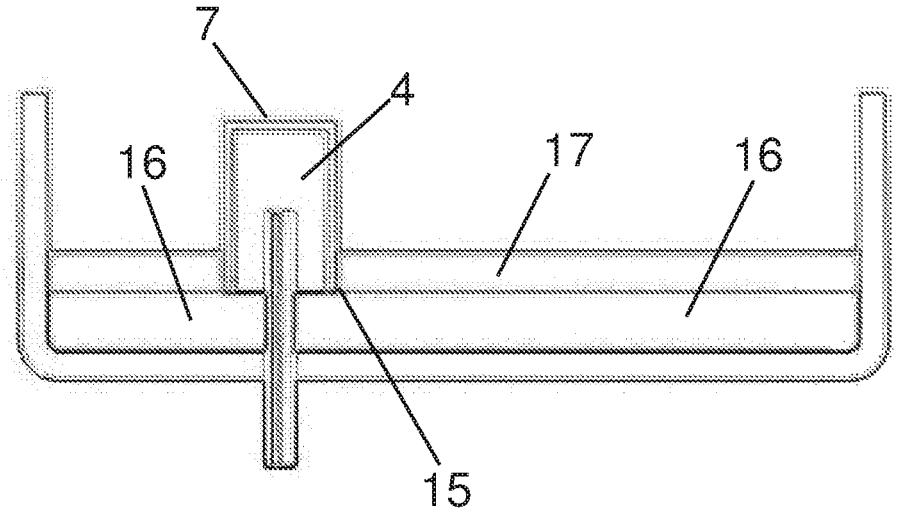

At this point, with the passage of a minimum amount of air from the outside of the cover 7 into the volume 4, accompanied by a negligible amount of slag 17, the depression inside the volume 4 is canceled and the level of molten metal material 16 inside the cover 7 lowers quickly reaching the lower edge 15, and thus the same level of the molten metal material outside the cover 7 (FIG. 3*h*).

When the tapping ends (FIG. 3*h*), and either scrap is loaded and/or melted in the vessel also during tapping or not, the method provides:

returning the bath of molten metal material 16 to a level between the lower edge 15 of the cover 7 and the upper edge 13 of the second stretch 5 of the tapping duct (FIG. 3*a*);

repeating the steps illustrated in FIGS. 3*b* to 3*h*.

Advantageously, the tapping duct 3 is always kept open, even during the melting of the scrap inside the vessel, without needing to obstruct the tapping hole with sand and without needing to provide a closing valve.

A first alternative to the one described above, in order to cancel the depression inside the volume 4 and interrupt the tapping, provides actuating the relief valve of the cover itself to equalize the pressure inside the cover 7 with that contained outside the cover, which generally corresponds to the atmospheric pressure present inside the vessel.

A second alternative provides, instead, tilting the vessel with respect to the horizontal plane in direction opposite to the tilting direction activating the tapping, i.e. so as to raise the level of molten metal material in the vessel zone in which the tapping duct is not present. In this manner, the tapping duct 3 passes from said first reference position to a third position, inclined with respect to said first reference position, until the level of molten metal material inside the volume 4 at least partially reaches the lower edge 15 of the cover 7, whereby allowing the passage of air inside the cover.

In these different manners, a perfect control on the amount of molten metal to be maintained inside the furnace (hot heel) is obtained for the successive melting.

The invention claimed is:

1. An operating method of a melting furnace comprising a vessel provided with a bottom;

a tapping duct passing through the bottom and having a first stretch arranged in a thickness of the bottom and completely passing through the bottom, and a second stretch, adjacent to the first stretch, protruding inside the vessel;

a fixed cover of the second stretch shaped as a bell, closed at an upper end thereof and open at a lower end thereof; said bell being coaxial and spaced from said second stretch, and being spaced from a zone of the bottom which includes the first stretch of the tapping duct, whereby the fixed cover, in cooperation with the second stretch of the tapping duct, defines a volume inside the fixed cover and adapted to act as a tapping hood;

rotation means adapted to rotate the vessel so that the tapping duct passes from a first reference position to a second position inclined with respect to said first reference position, and vice versa;

the method comprising the following steps:

a) providing the vessel with the tapping duct in the first reference position and providing a bath of molten metal material at an equal level both inside and outside the fixed cover and comprised between the lower end of the fixed cover and an upper edge of the second stretch, a slag being kept on a surface of said bath outside the fixed cover;

b) rotating the vessel in a first direction so that the tapping duct passes from said first reference position to said second position inclined until the level of molten metal material reaches the upper edge of the second stretch so that the molten metal material begins to be tapped through the tapping duct creating a depression inside the volume;

c) rotating the vessel in a second direction, opposite the first direction, so that the tapping duct returns to the first reference position, while, due to said depression, the molten metal material passes from the outside of the fixed cover to the inside of the volume and continues to be tapped through the tapping duct until said depression is canceled.

2. The method according to claim 1, wherein in step c) said depression is canceled when the level of molten metal material outside the fixed cover reaches a lower edge of the lower end of the fixed cover, whereby, at a passage of air from the outside of the fixed cover to the inside of the volume, the level of molten metal material inside the fixed cover is lowered, reaching the lower edge, and therefore reaching the level of the molten metal material outside the fixed cover;

or wherein said depression is canceled by operating a relief valve provided on the fixed cover;

or wherein said depression is canceled by further rotating the vessel in said second direction, so that the tapping duct passes from said first reference position to a third position inclined with respect to said first reference position until the level of molten metal material inside the volume reaches the lower edge of the fixed cover.

3. The method according to claim 1, wherein, following step c), with the tapping duct in the first reference position, there are provided the steps of:

returning the bath of molten metal material to a level between the lower end of the fixed cover and the upper edge of the second stretch;

repeating steps b) and c).

4. The method according to claim 1, wherein during at least steps b) and c) it is possible to load and/or melt scrap inside the vessel, also during the tapping.

5. The method according to claim 1, wherein the tapping duct is always kept open, also during the melting of scrap inside the vessel.

* * * * *